US010563891B2

(12) United States Patent
Smerud et al.

(10) Patent No.: US 10,563,891 B2
(45) Date of Patent: Feb. 18, 2020

(54) VARIABLE DISPLACEMENT SCROLL COMPRESSOR

(71) Applicant: TRANE INTERNATIONAL INC., Davidson, NC (US)

(72) Inventors: Scott J. Smerud, La Crosse, WI (US); Eric S. Mlsna, Cashton, WI (US); Torin Allan Betthauser, La Crosse, WI (US); Adam P. Kimball, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 286 days.

(21) Appl. No.: 15/416,925

(22) Filed: Jan. 26, 2017

(65) Prior Publication Data

US 2018/0209421 A1 Jul. 26, 2018

(51) Int. Cl.
*F04C 18/02* (2006.01)
*F04C 27/00* (2006.01)
(Continued)

(52) U.S. Cl.
CPC ..... *F25B 41/04* (2013.01); *F04C 18/0215* (2013.01); *F04C 18/0261* (2013.01);
(Continued)

(58) Field of Classification Search
CPC .. F04C 18/0215; F04C 18/261; F04C 27/001; F04C 28/26; F04C 18/0207; F04C 18/0253; F04C 29/128; F25B 41/04
(Continued)

(56) References Cited

U.S. PATENT DOCUMENTS 5,640,854 A * 6/1997 Fogt ..... F01C 1/0215 418/55.6
6,783,110 B2 * 8/2004 Hirota ..... F16K 1/123 251/129.08
(Continued)

FOREIGN PATENT DOCUMENTS

EP 2541066 A1 1/2013
FR 2968732 A1 6/2012
WO 2012/080613 A2 6/2012

OTHER PUBLICATIONS

Extended European Search Report; European Patent Application No. 18153363.9, dated May 3, 2018 (8 pages).

*Primary Examiner* — Deming Wan
(74) *Attorney, Agent, or Firm* — Hamre, Schumann, Mueller & Larson, P.C.

(57) ABSTRACT

A scroll compressor is disclosed. The scroll compressor includes a compressor housing; an orbiting scroll member disposed within the housing; a non-orbiting scroll member disposed within the housing, wherein the orbiting scroll member and the non-orbiting scroll member are intermeshed thereby forming a compression chamber within the housing; and an endplate secured to the non-orbiting scroll member. The endplate includes a check valve surface configured to provide a stop for a check valve of the scroll compressor, a radial sealing surface configured to receive a radial seal, an unloading mechanism surface configured to provide a stop for an unloading mechanism, and a pressure chamber for controlling the unloading mechanism, the endplate also including an aperture that fluidly connects the compression chamber and a discharge chamber of the scroll compressor.

17 Claims, 9 Drawing Sheets

(51) Int. Cl.

| | |
|---|---|
| ***F04C 28/26*** | (2006.01) |
| ***F04C 29/12*** | (2006.01) |
| ***F25B 41/04*** | (2006.01) |
| ***F25B 1/04*** | (2006.01) |

(52) U.S. Cl.
CPC ..... *F04C 27/001* (2013.01); *F25B 1/04* (2013.01); *F04C 2240/30* (2013.01); *F25B 2600/0262* (2013.01); *F25B 2600/2507* (2013.01)

(58) Field of Classification Search
USPC ..... 418/55.1, 55.4
See application file for complete search history.

(56) References Cited

U.S. PATENT DOCUMENTS

| | | | | |
|---|---|---|---|---|
| 7,094,038 | B2 * | 8/2006 | Choi | F04C 23/008 417/310 |
| 7,972,125 | B2 | 7/2011 | Stover et al. | |
| 9,017,050 | B2 * | 4/2015 | Ginies | F04C 18/0253 417/308 |
| 2002/0071773 | A1 | 6/2002 | Matsuba et al. | |
| 2007/0183915 | A1 * | 8/2007 | Guo | F04C 18/0215 418/55.6 |
| 2007/0212244 | A1 * | 9/2007 | Futagami | F04C 18/0215 418/55.2 |
| 2011/0033328 | A1 | 2/2011 | Stover et al. | |
| 2012/0100024 | A1 * | 4/2012 | Tang | F04C 18/0215 418/1 |
| 2014/0140876 | A1 | 5/2014 | Bingham et al. | |
| 2015/0316054 | A1 * | 11/2015 | Jin | F04O 18/0223 418/55.2 |

* cited by examiner

VARIABLE DISPLACEMENT SCROLL COMPRESSOR

FIELD

This disclosure relates generally to vapor compression systems. More specifically, this disclosure relates to a scroll compressor in a vapor compression system such as, but not limited to, a heating, ventilation, air conditioning, and refrigeration (HVACR) system.

BACKGROUND

One type of compressor for a vapor compression system is generally referred to as a scroll compressor. Scroll compressors generally include a pair of scroll members which orbit relative to each other to compress a working fluid such as, but not limited to, air or a refrigerant. A typical scroll compressor includes a first, stationary scroll member having a base and a generally spiral wrap extending from the base, and a second, orbiting scroll member having a base and a generally spiral wrap extending from the base. The spiral wraps of the first and second orbiting scroll members are intermeshed, creating a series of compression chambers. The second, orbiting scroll member is driven to orbit the first, stationary scroll member by rotating a shaft. Some scroll compressors employ an eccentric pin on the rotating shaft that drives the second, orbiting scroll member.

SUMMARY

A scroll compressor is disclosed. The scroll compressor includes a compressor housing; an orbiting scroll member disposed within the housing; a non-orbiting scroll member disposed within the housing, wherein the orbiting scroll member and the non-orbiting scroll member are intermeshed thereby forming a compression chamber within the housing; and an endplate secured to the non-orbiting scroll member. The endplate includes a check valve surface configured to provide a stop for a check valve of the scroll compressor, a radial sealing surface configured to receive a radial seal, an unloading mechanism surface configured to provide a stop for an unloading mechanism, and a pressure chamber for controlling the unloading mechanism, the endplate also including an aperture that fluidly connects the compression chamber and a discharge chamber of the scroll compressor.

An endplate for a scroll compressor is disclosed. In an embodiment, the endplate includes a member including a check valve surface configured to provide a stop for a check valve of the scroll compressor, a radial sealing surface configured to receive a radial seal, an unloading mechanism surface configured to provide a stop for an unloading mechanism, and a pressure chamber for controlling the unloading mechanism, the endplate also including an aperture that fluidly connects the compression chamber and a discharge chamber of the scroll compressor.

A refrigerant circuit is also disclosed. The refrigerant circuit includes a compressor, a condenser, an expansion device, and an evaporator fluidly connected, wherein a working fluid flows therethrough. The compressor is a scroll compressor and includes a compressor housing; an orbiting scroll member disposed within the housing; a non-orbiting scroll member disposed within the housing, wherein the orbiting scroll member and the non-orbiting scroll member are intermeshed thereby forming a compression chamber within the housing; and an endplate secured to the non-orbiting scroll member. The endplate includes a check valve surface configured to provide a stop for a check valve of the scroll compressor, a radial sealing surface configured to receive a radial seal, an unloading mechanism surface configured to provide a stop for an unloading mechanism, and a pressure chamber for controlling the unloading mechanism, the endplate also including an aperture that fluidly connects the compression chamber and a discharge chamber of the scroll compressor.

BRIEF DESCRIPTION OF THE DRAWINGS

References are made to the accompanying drawings that form a part of this disclosure and which illustrate embodiments in which the systems and methods described in this specification can be practiced.

Like reference numbers represent like parts throughout.

DETAILED DESCRIPTION

This disclosure relates generally to vapor compression systems. More specifically, this disclosure relates to a scroll compressor in a vapor compression system such as, but not limited to, a heating, ventilation, air conditioning, and refrigeration (HVACR) system.

A scroll compressor may be used to compress a working fluid (e.g., air, heat transfer fluid (such as, but not limited to, refrigerant, or the like), etc.). A scroll compressor can be included in an HVACR system to compress a working fluid (e.g., a heat transfer fluid such as a refrigerant) in a refrigerant circuit. The scroll compressor generally includes a fixed scroll and an orbiting scroll intermeshed with each other, forming compression chambers.

Figure 1:
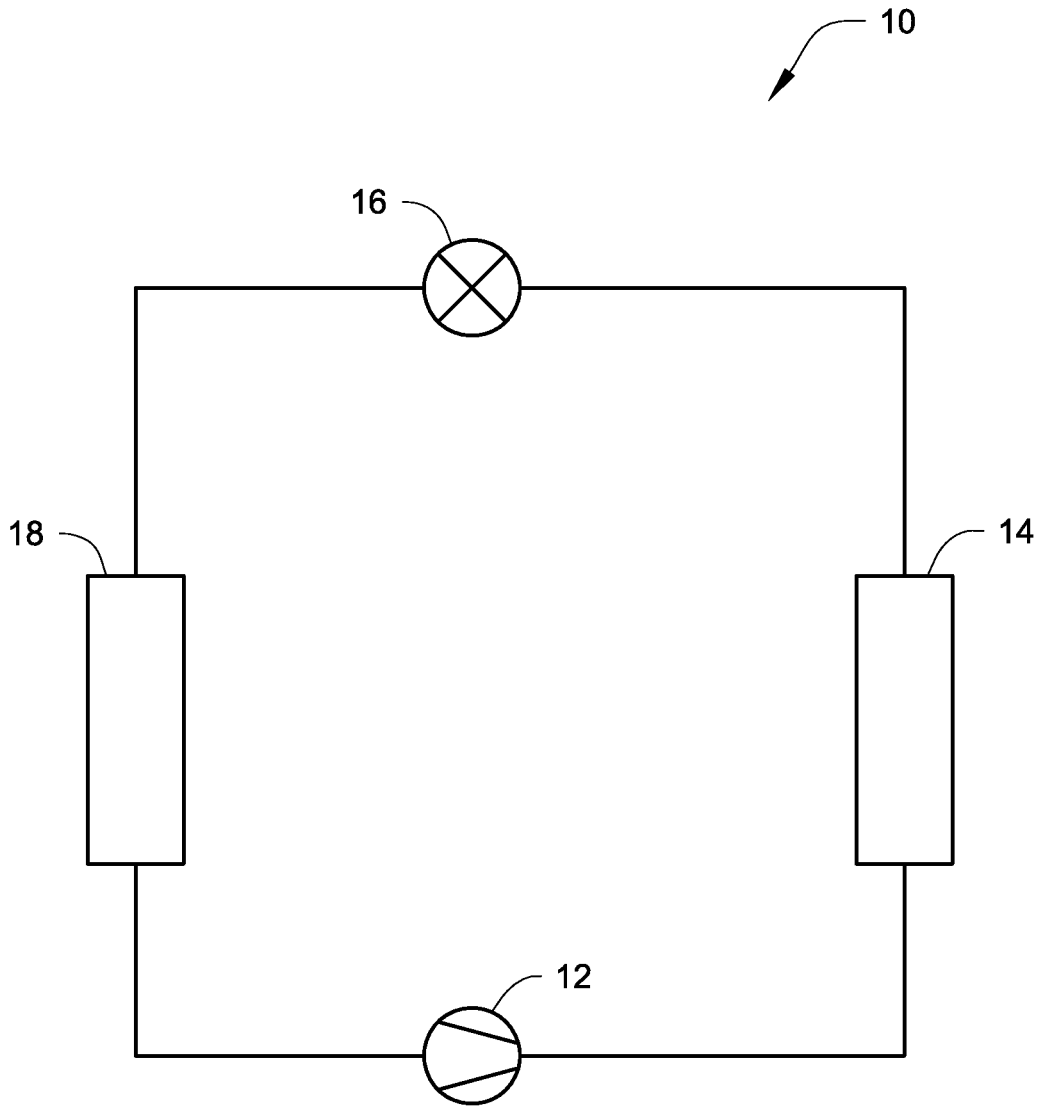
FIG. 1 is a schematic diagram of a refrigerant circuit, according to an embodiment.

FIG. 1 is a schematic diagram of a refrigerant circuit 10, according to an embodiment. The refrigerant circuit 10 generally includes a compressor 12, a condenser 14, an expansion device 16, and an evaporator 18. The compressor 12 can be, for example, a scroll compressor such as the scroll compressor shown and described in accordance with FIGS. 2A-2B below. The refrigerant circuit 10 is an example and can be modified to include additional components. For example, in an embodiment, the refrigerant circuit 10 can include other components such as, but not limited to, an economizer heat exchanger, one or more flow control devices, a receiver tank, a dryer, a suction-liquid heat exchanger, or the like.

The refrigerant circuit 10 can generally be applied in a variety of systems used to control an environmental condition (e.g., temperature, humidity, air quality, or the like) in a space (generally referred to as a conditioned space). Examples of such systems include, but are not limited to, HVACR systems, transport refrigeration systems, or the like.

The compressor 12, condenser 14, expansion device 16, and evaporator 18 are fluidly connected. In an embodiment, the refrigerant circuit 10 can be configured to be a cooling system (e.g., an air conditioning system) capable of operating in a cooling mode. In an embodiment, the refrigerant circuit 10 can be configured to be a heat pump system that can operate in both a cooling mode and a heating/defrost mode.

The refrigerant circuit 10 can operate according to generally known principles. The refrigerant circuit 10 can be configured to heat or cool a liquid process fluid (e.g., a heat transfer fluid or medium such as, but not limited to, water or the like), in which case the refrigerant circuit 10 may be generally representative of a liquid chiller system. The refrigerant circuit 10 can alternatively be configured to heat or cool a gaseous process fluid (e.g., a heat transfer medium or fluid such as, but not limited to, air or the like), in which case the refrigerant circuit 10 may be generally representative of an air conditioner or heat pump.

In operation, the compressor 12 compresses a working fluid (e.g., a heat transfer fluid such as a refrigerant or the like) from a relatively lower pressure gas to a relatively higher-pressure gas. The relatively higher-pressure gas is also at a relatively higher temperature, which is discharged from the compressor 12 and flows through the condenser 14. The working fluid flows through the condenser 10 and rejects heat to a process fluid (e.g., water, air, etc.), thereby cooling the working fluid. The cooled working fluid, which is now in a liquid form, flows to the expansion device 16. The expansion device 16 reduces the pressure of the working fluid. As a result, a portion of the working fluid is converted to a gaseous form. The working fluid, which is now in a mixed liquid and gaseous form flows to the evaporator 18. The working fluid flows through the evaporator 18 and absorbs heat from a process fluid (e.g., water, air, etc.), heating the working fluid, and converting it to a gaseous form. The gaseous working fluid then returns to the compressor 12. The above-described process continues while the refrigerant circuit is operating, for example, in a cooling mode (e.g., while the compressor 12 is enabled).

Figure 2A:
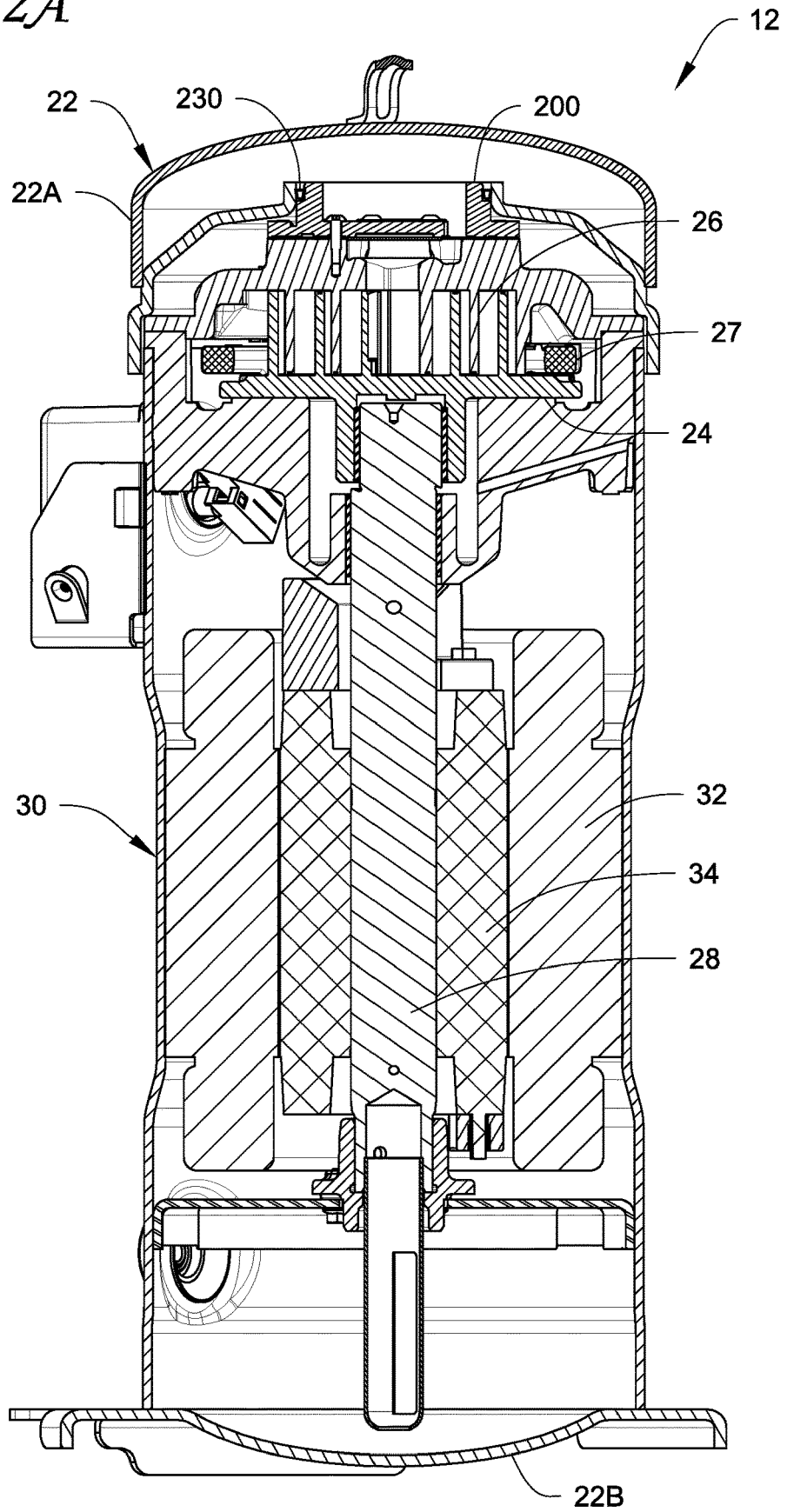
FIGS. 2A-2B illustrate sectional views of a compressor with which embodiments as disclosed in this specification can be practiced, according to an embodiment.
Figure 2B:
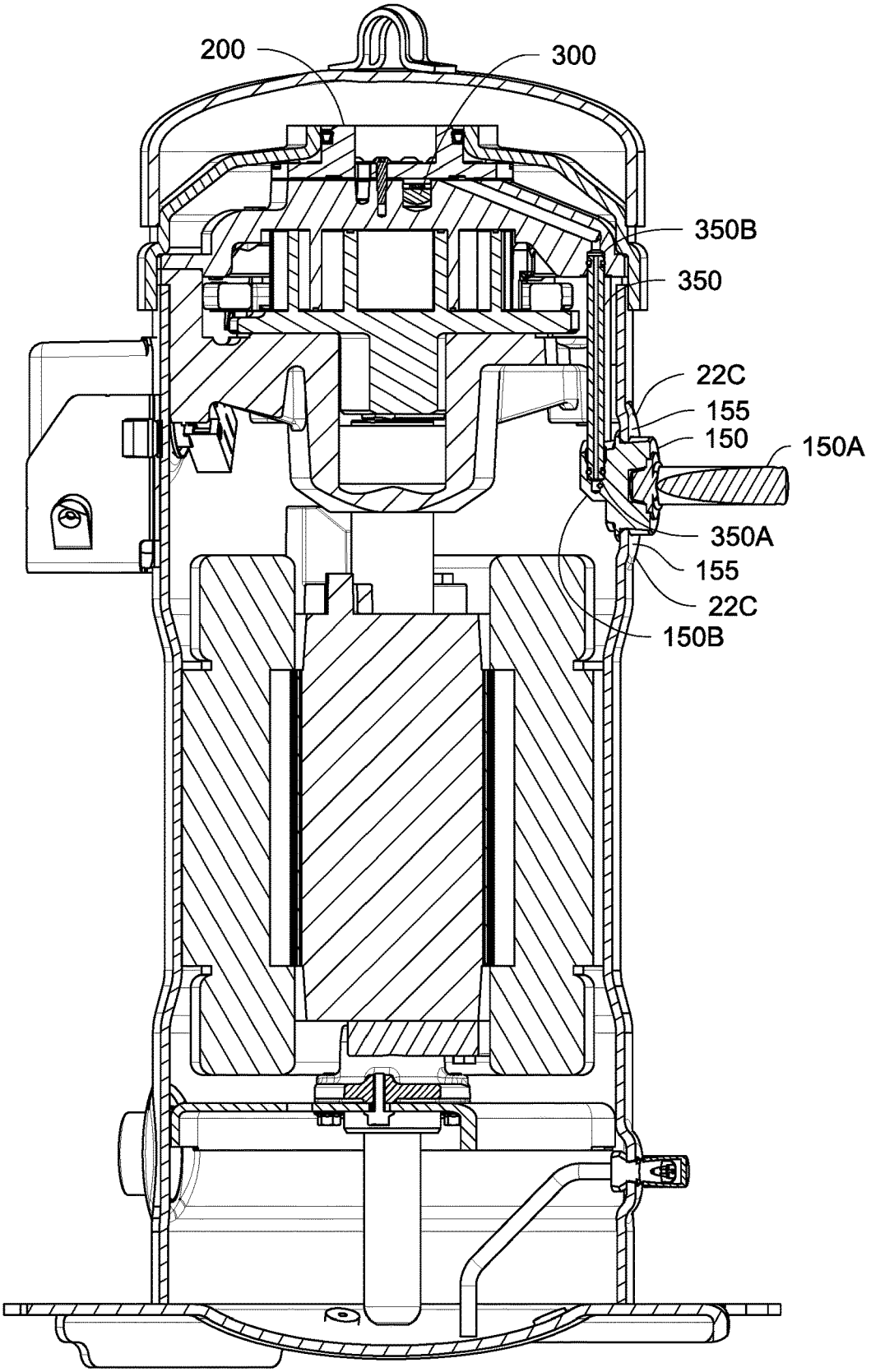

FIGS. 2A and 2B illustrate various sectional views of a compressor 120 with which embodiments as disclosed in this specification can be practiced, according to an embodiment. The compressor 120 can be used as the compressor 12 in the refrigerant circuit 10 of FIG. 1. It is to be appreciated that the compressor 120 can also be used for purposes other than in a refrigerant circuit. For example, the compressor 120 can be used to compress air or gases other than a heat transfer fluid (e.g., natural gas, etc.). It is to be appreciated that the scroll compressor 120 includes additional features that are not described in detail in this specification. For example, the scroll compressor 120 can include a lubricant sump for storing lubricant to be introduced to the moving features of the scroll compressor 120.

The illustrated compressor 120 is a single-stage scroll compressor. More specifically, the illustrated compressor 120 is a single-stage vertical scroll compressor. It is to be appreciated that the principles described in this specification are not intended to be limited to single-stage scroll compressors and that they can be applied to multi-stage scroll compressors having two or more compression stages. Generally, the embodiments as disclosed in this specification are suitable for a compressor with a vertical or a near vertical crankshaft (e.g., crankshaft 28). It is to be appreciated that the embodiments may also be applied to a horizontal compressor with a horizontal or a near horizontal crankshaft.

The compressor 120 is illustrated in sectional side view. The scroll compressor 120 includes an enclosure 22. The enclosure 22 includes an upper portion 22A and a lower portion 22B.

The compressor 120 includes an orbiting scroll 24 and a non-orbiting scroll 26. The non-orbiting scroll 26 can alternatively be referred to as, for example, the stationary scroll 26, the fixed scroll 26, or the like. The non-orbiting scroll 26 is aligned in meshing engagement with the orbiting scroll 24 by means of an Oldham coupling 27.

The compressor 120 includes a driveshaft 28. The driveshaft 28 can alternatively be referred to as the crankshaft 28. The driveshaft 28 can be rotatably driven by, for example, an electric motor 30. The electric motor 30 can generally include a stator 32 and a rotor 34. The driveshaft 28 is fixed to the rotor 34 such that the driveshaft 28 rotates along with the rotation of the rotor 34. The electric motor 30, stator 32, and rotor 34 can operate according to generally known principles. The driveshaft 28 can, for example, be fixed to the rotor 34 via an interference fit or the like. The driveshaft 28 can, in an embodiment, be connected to an external electric motor, an internal combustion engine (e.g., a diesel engine or a gasoline engine), or the like. It will be appreciated that in such embodiments the electric motor 30, stator 32, and rotor 34 would not be present in the compressor 120.

In an embodiment, the compressor 120 can be a variable displacement compressor. That is, the compressor 120 can vary its capacity to meet cooling demands. This can, for example, provide an increased efficiency for the compressor 120 at an intermediate load than a constant displacement compressor. In an embodiment, the variable displacement compressor can reduce over-pressurization of the working fluid can result in an increased efficiency of the scroll compressor. In an embodiment, the increased efficiency may be particularly significant when the compressor is operating at a part load.

With reference to FIG. 2B, the compressor 120 includes the enclosure 22. In an embodiment, the enclosure 22 can be generally cylindrical. As used in this specification, generally cylindrical is intended to refer to a cylindrical shape with some variation due to, for example, manufacturing tolerances. A solenoid valve 150 can be secured to the enclosure 22. The solenoid valve 150 can generally be used to control pressure to an unloading mechanism (e.g., unloading mechanism 300 in FIGS. 5A-5J) for the compressor 120.

At a location of connection of the solenoid valve 150, a portion 22C of the enclosure can be modified to, for example, provide a flattened surface 155 which can be used to secure the solenoid valve 150 to the enclosure 22. A portion 150A of the solenoid valve 150 is disposed on an outside of the enclosure 22, while a portion 150B of the solenoid valve 150 is disposed on an inside of the enclosure 22. The portion 22C providing the flattened surface 155 is relatively larger than a diameter of the solenoid valve 150.

In an embodiment, the solenoid valve 150 can be secured to the enclosure 22 via a resistance welding process. In an embodiment, the resistance welding process may be preferred because the procedure is relatively cheaper and relatively faster than other welding procedures. Further, the resistance welding process can be performed with relatively minimal addition of heat compared to other welding procedures.

In an embodiment, securing the solenoid valve 150 directly to the enclosure 22 can, for example, reduce a number of components used for the connection. For example, in prior systems, a gasket, a flange, and one or more fasteners may also be used to secure the solenoid valve to the enclosure 22. Securing the solenoid valve 150 directly to the enclosure 22 as in FIG. 2B can reduce a manufacturing cost of the compressor 120, according to an embodiment. Additionally, a radial size/radial footprint of the compressor 120 may be relatively smaller as compared to prior compressors because of the reduction in components (e.g., gasket, flange, fasteners). The particular structure of the solenoid valve 150 is not intended to be limiting. It will be appreciated that different solenoid valves may have different structures as appropriate for the particular compressor application.

The solenoid valve 150 can be fluidly connected to an unloading mechanism (e.g., unloading mechanism 300 in FIGS. 4A-4J below) via a plurality of conduits 350. A first end 350A of the conduit 350 is secured to the solenoid valve 150 and a second end 350B of the conduit 350 is secured to endplate 200 to selectively provide fluid therebetween and control a state of the unloading mechanism. An embodiment of the end 350A, 350B of the conduit 350 is shown and described in additional detail in accordance with FIG. 5 below.

The solenoid valve 150 can selectively control the unloading mechanism 300. The selective control of the unloading mechanism 300 can, for example, enable discharging the working fluid from the compression chamber of the compressor 120 at an intermediate pressure. That is, the unloading mechanism 300 can be selectively controlled via the solenoid valve 150 to, for example, discharge the working fluid at an intermediate pressure that is relatively less than the discharge pressure. Such unloading can be used, for example, when the compressor 120 is operated at a part load. In part load conditions, releasing the working fluid at the intermediate pressure can prevent over-pressurization of the working fluid. Releasing the working fluid at the intermediate pressure includes discharging the working fluid from the compression pocket of the intermeshed scrolls 24, 26 at a location before reaching the typical discharge port. This can, in an embodiment, increase an efficiency of the compressor 120 when operating at part load.

Figure 3A:
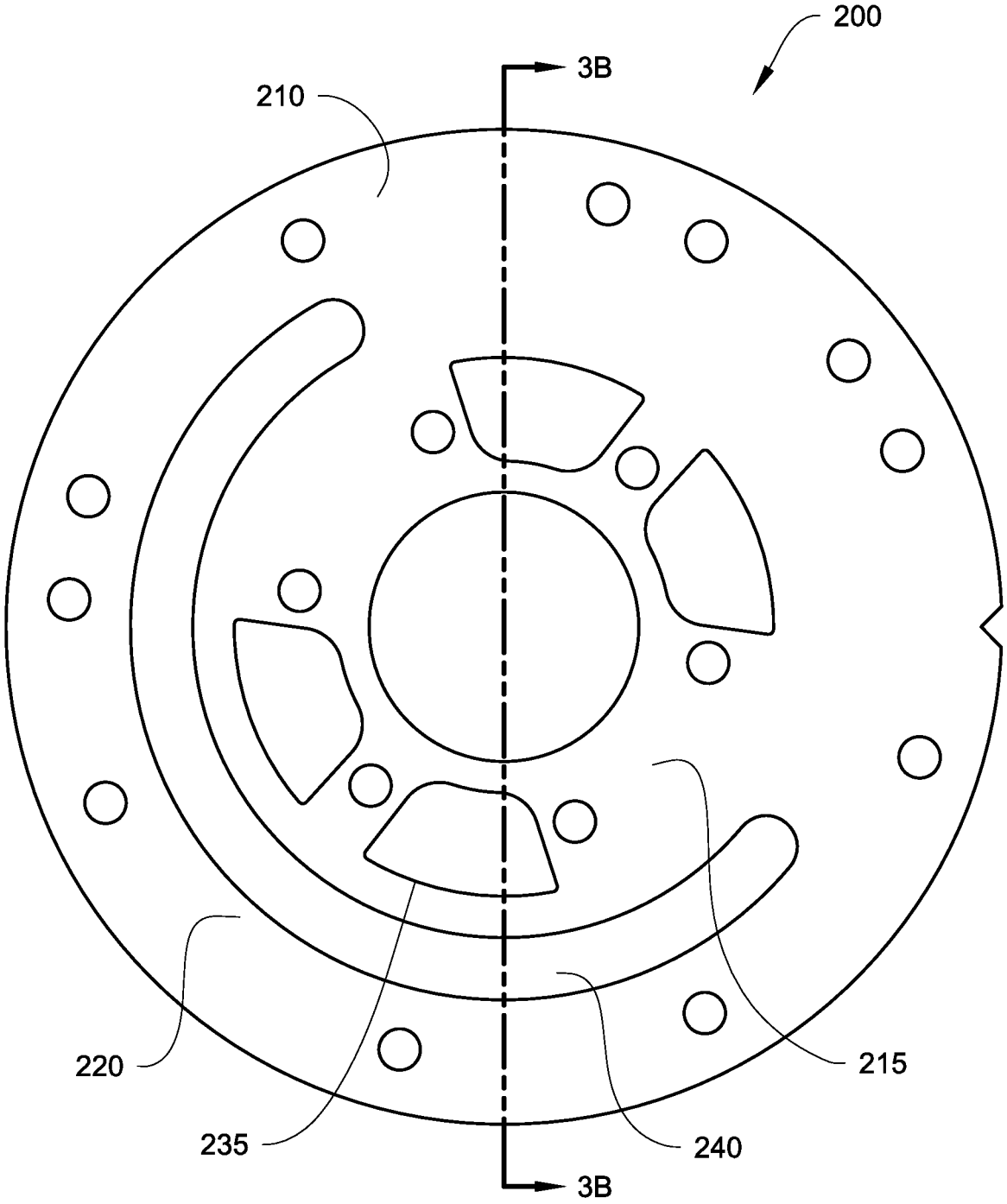
FIGS. 3A-3B illustrate an endplate for the compressor of FIGS. 2A-2B, according to an embodiment.
Figure 3B:
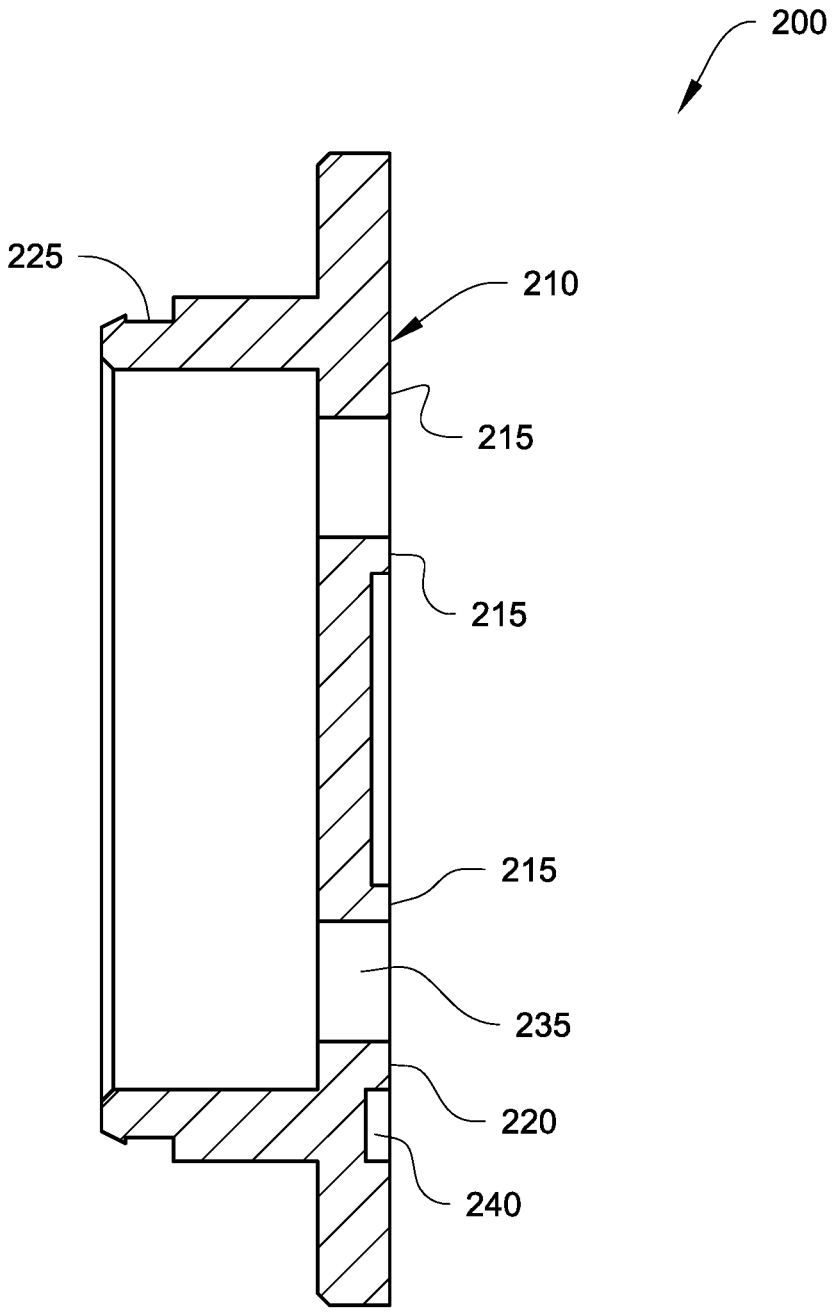

FIGS. 3A-3B illustrate an endplate 200 for the compressor 120, according to an embodiment. FIG. 3A is a bottom perspective view of the endplate 200. FIG. 3B is a side sectional view of the endplate 200. For simplicity, FIGS. 3A-3B will be discussed generally and with some specific references to each of the figures.

The endplate 200 generally can provide several functions in a single component in the compressor 120. The endplate 200 can provide a surface to serve as a check valve stop, a radial sealing surface for a radial seal, a surface providing a piston stop for the unloading mechanism 300 (FIGS. 4A-4J), and a pressure chamber for controlling the unloading mechanism of the compressor 120.

The endplate 200 is a single member, formed of a unitary, one-piece construction. In an embodiment, the endplate 200 may be made of a machined, powdered metal. It will be appreciated that the endplate 200 can be made of other materials and via a variety of manufacturing processes. In an embodiment, because the endplate 200 is a single member, formed of a unitary, one-piece construction, the endplate 200 can be relatively small in size. In an embodiment, the relatively small size can assist in reducing an overall size of the compressor 120 (FIGS. 2A-2B) in an axial direction (e.g., a height in a vertical direction with respect to the page of the compressor 120 can be reduced). The relatively small size, and reduced compressor size, can be advantageous for implementation in an environment in which there is limited space available for the compressor 120.

The endplate 200 includes a bottom surface 210. The bottom surface 210 mates with a surface of the non-orbiting scroll 26. The bottom surface 210 can be generally circular, subject to, for example, manufacturing tolerances. A relatively inner portion of the bottom surface 210 can provide a surface 215 which can serve as a stop for a check valve in the compressor 120. A relatively outer portion of the bottom surface 210 can provide a surface 220 which can serve as a stop for an unloading mechanism (e.g., unloading mechanism 300 in FIGS. 5A-5J). A surface 225 can provide a seat for a seal, such as a radial seal or gasket. For simplicity, the radial seal is not shown in FIGS. 3A-3B. In FIGS. 2A-2B, the endplate 200 includes a radial seal 230. In an embodiment, the radial seal 230 can provide a pressure seal between a high pressure volume above the radial seal 230 (e.g., discharge side) and the low pressure volume below it (e.g., suction side). The radial seal 230 can, in an embodiment, limit a pressure differential across the non-orbiting scroll 26 to an area inside the radial seal 230 which can enable an axial gap between the non-orbiting scroll 26 and the orbiting 24 to be relatively reduced. In an embodiment, the radial seal 230 can also provide a break in a transmission path for sound between the non-orbiting scroll 26 and the enclosure 22.

As illustrated in FIG. 3A, a plurality of apertures 235 is formed in the endplate 200. The apertures 235 fluidly connect the compression chamber of the compressor 120 with a discharge of the compressor 120. Accordingly, the working fluid can be provided to the discharge of the compressor 120 via the apertures 235. When the unloading mechanism is in a flow disabled state, the working fluid being provided to the apertures 235 is at a discharge pressure. When the unloading mechanism is in a flow enabled state, the working fluid being provided to the apertures 235 is at an intermediate pressure that is between the suction pressure and the discharge pressure. The surface 210 also includes one or more channels 240. In an embodiment, the one or more channels 240 can alternatively be placed in the non-orbiting scroll 26 or a gasket (or series of gaskets) disposed between the non-orbiting scroll 26 and the endplate 200. The one or more channels 240 provide the working fluid from the solenoid valve 150 (FIG. 2B) to selectively control whether the unloading mechanism is in the flow disabled state or the flow enabled state.

The endplate 200 can generally include a plate portion 200A and a portion 200B extending from the plate portion 200A. In an embodiment, the plate portion 200A can be generally circular, subject to, for example, manufacturing tolerances. The portion 200B extending from the plate portion 200A can, for example, be generally cylindrical, subject to, for example, manufacturing tolerances.

FIGS. 4A-4J illustrate schematic views of unloading mechanism 300, according to an embodiment. The unloading mechanism 300 can alternatively be referred to as the piston 300.

Figure 4A:
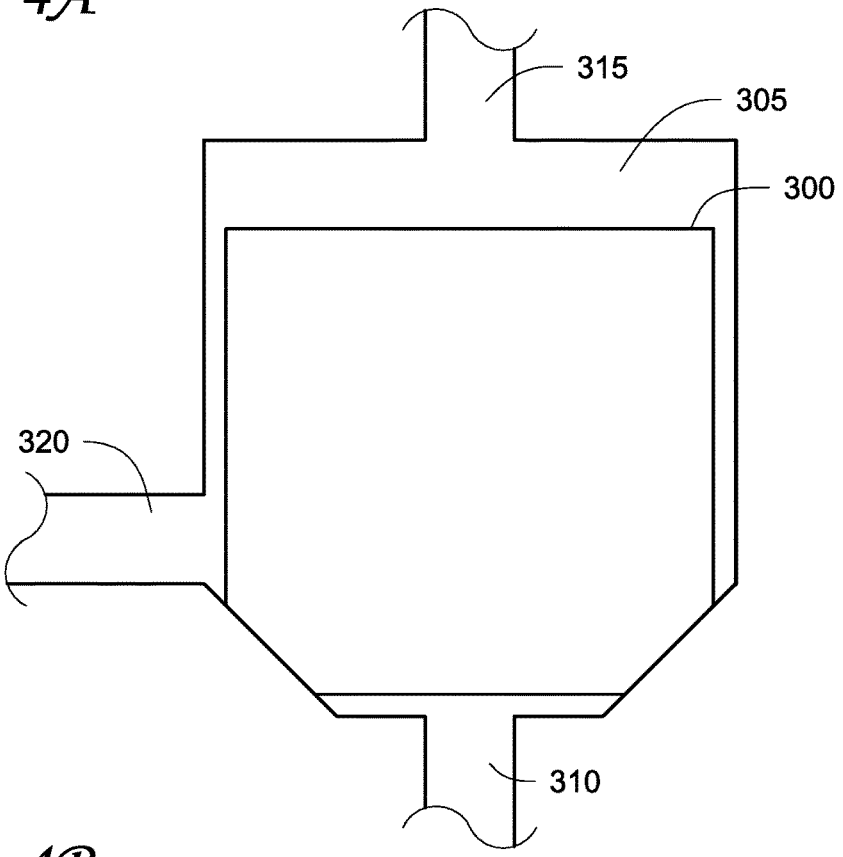
FIGS. 4A-4J illustrate schematic views of an unloading mechanism for the compressor of FIGS. 2A-2B, according to an embodiment.

FIG. 4A is a schematic diagram including a side sectional view of the unloading mechanism 300 in the compressor 120, according to an embodiment. The unloading mechanism is disposed within a chamber 305. The chamber has an inlet 310, a first outlet 315, and a second outlet 320. The inlet 310 fluidly communicates with the compression chamber of the compressor 120. The inlet 310 is disposed in a location of the compression chamber at which the working fluid is at an intermediate pressure. That is, the inlet 310 corresponds to a location along the scroll that is disposed between an entry point of the working fluid and a discharge point of the working fluid (e.g., a location at which the working fluid has been partially compressed). The intermediate pressure is between a suction pressure and a discharge pressure of the compressor 120. In an embodiment, the outlet 315 can alternately fluidly communicate with the discharge and suction ports of the compressor 120. The outlet 320 fluidly communicates with the suction port of the compressor 120.

Figure 4B:
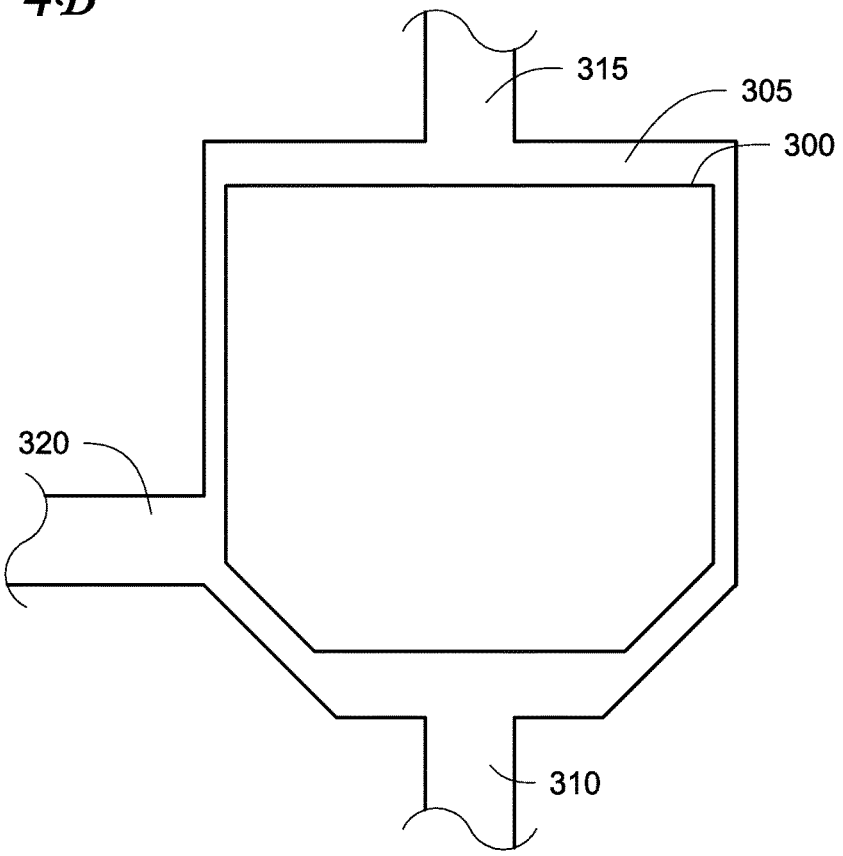

The unloading mechanism 300 can travel in a vertical direction with respect to the page between a flow enabled and a flow disabled state. In the illustrated embodiment, the unloading mechanism 300 is in the flow disabled state. In the flow disabled state, the working fluid in the compression chamber is prevented from flowing from the outlet 310 to the outlet 320. FIG. 4B illustrates the flow enabled state, in which the working fluid can be provided from the inlet 310 to the outlet 320.

The unloading mechanism 300 is designed such that it can move between the flow enabled and the flow disabled states. However, if the unloading mechanism 300 is not sealed, working fluid may flow back from the outlet 315 (e.g., a discharge pressure) to the outlet 320 (e.g., the suction pressure) because of the pressure differential between the two outlets 315, 320. To prevent this back flow of the working fluid, the unloading mechanism can include one or more surfaces having a modified surface. The modified surface can increase a seal between a wall of the chamber 305 and the surface of the unloading mechanism 300. Various configurations are shown in FIGS. 4C-4J. It will be appreciated that these configurations are examples and that the specific geometry can vary according to the principles described in this specification. In some embodiments, a seal activator 325 (also referred to as a piston seal, gasket, etc.) can also be included with the surface modification to further reduce a likelihood of the working fluid flowing back from the outlet 315 to the outlet 320.

The embodiments in FIGS. 4C-4J represent various geometries for the unloading mechanism 300 which can sealingly engage with an inner diameter of the chamber 305.

Figure 4C:
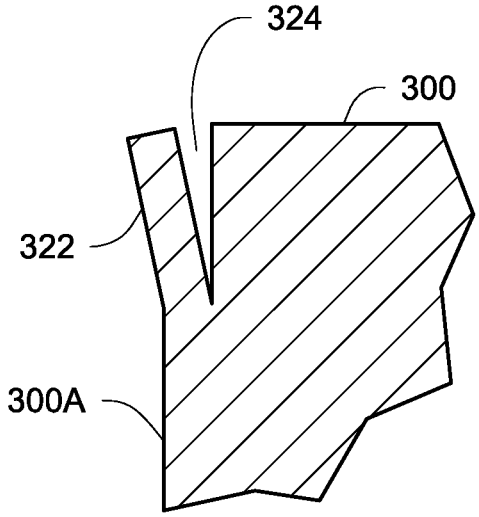

In FIG. 4C, a radial surface 300A of the unloading mechanism 300 includes a radial surface modification 322. The radial surface modification 322 can be formed by, for example, removing an area 324 of material in the unloading mechanism 300. The surface modification 322 can, when inserted into the chamber 305 (FIG. 4A), form a sealing engagement with the inner surface of the chamber 305.

Figure 4D:
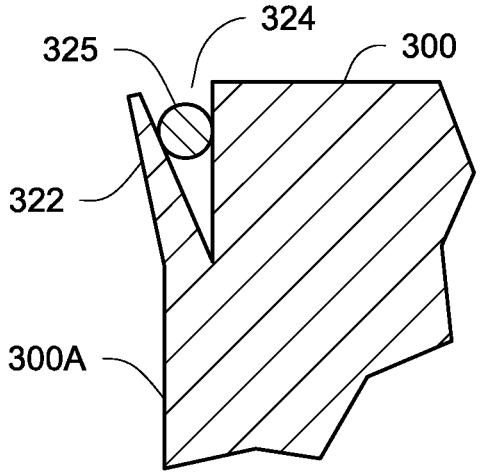

In FIG. 4D, a similar surface modification 322 can be formed by removing an area 324 from the unloading mechanism 300. Additionally, the seal activator 325 can be included in the area 324 to provide additional resistance and additional force for the sealing engagement between the surface modification and the inner surface of the chamber 305.

Figure 4E:
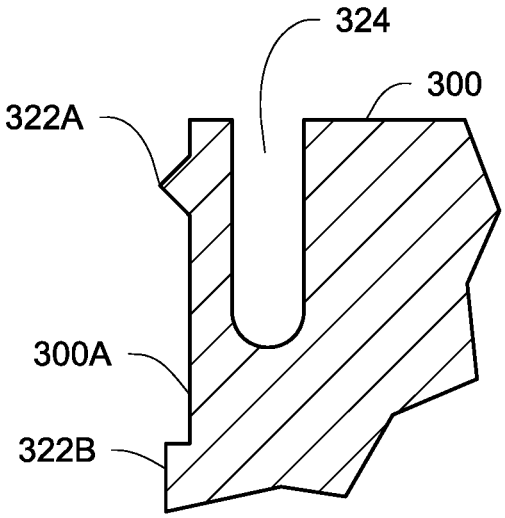

In FIG. 4E, the unloading mechanism 300 can include a plurality of surface modifications 322A, 322B. The plurality of surface modifications 322A, 322B can be protrusions from the radial surface 300A of the unloading mechanism 300. It will be appreciated that a location along the radial surface 300A of the surface modifications 322A, 322B can vary, according to an embodiment.

Figure 4F:
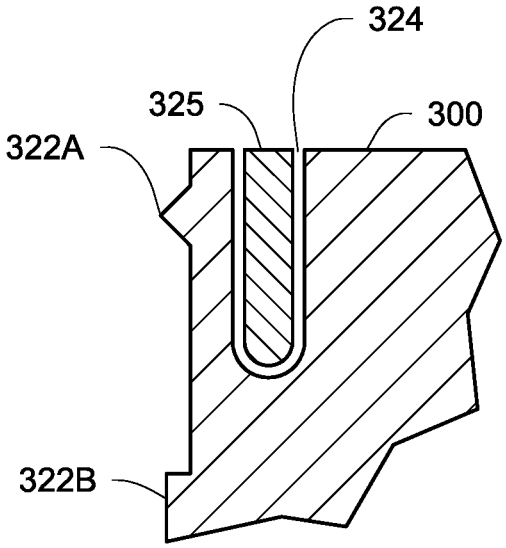

FIG. 4F includes the surface modifications 322A, 322B as illustrated in FIG. 4E. Additionally, the area 324 is provided with the seal activator 325. The seal activator 325 can generally provide a force to help maintain the surface modification 322A in a sealing engagement with the inner surface of the chamber 305.

Figure 4G:
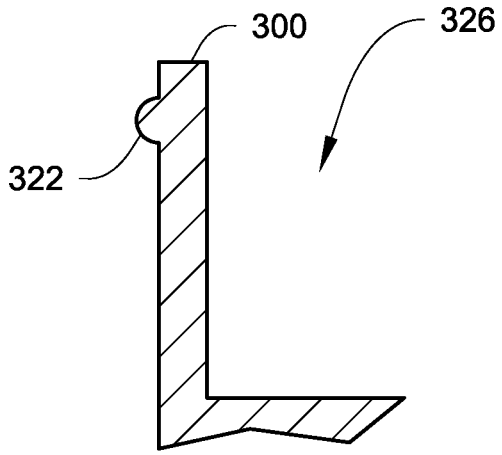

FIG. 4G includes the surface modification 322 disposed on the radial surface 300A of the unloading mechanism 300. The embodiment in FIG. 4G illustrates a piston having a hollowed out central region. In an embodiment, this configuration can reduce an amount of material used for the unloading mechanism 300. In an embodiment, this can result in a relatively lower manufacturing cost.

Figure 4H:
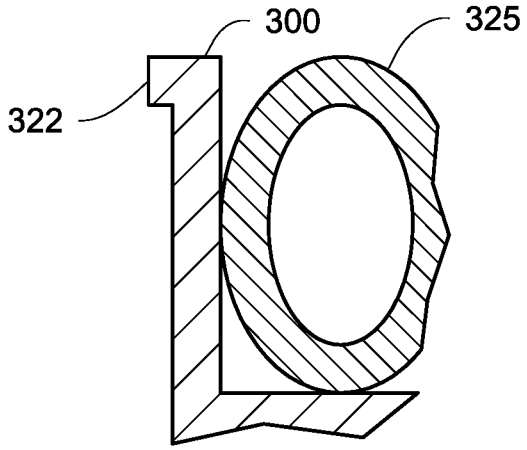

FIG. 4H includes the surface modification 322 disposed on the radial surface 300A of the unloading mechanism 300. Similar to the embodiment of FIG. 4G, the unloading mechanism 300 in FIG. 4H has a hollowed out central region. In the illustrated embodiment, the seal activator 325 is included in the hollowed out central region.

Figure 4I:
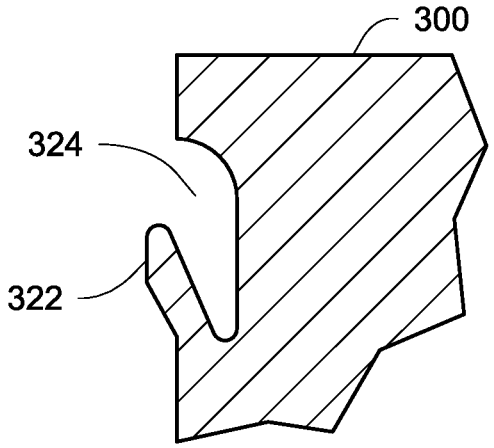

FIG. 4I includes the surface modification 322 formed on the radial surface 300A of the unloading mechanism 300. In the illustrated embodiment, the surface modification 322 is formed by removing an area 324 of the unloading mechanism 300. In the illustrated embodiment, the surface modification 322 is formed at a location that is different from the surface modification in FIG. 4C.

Figure 4J:
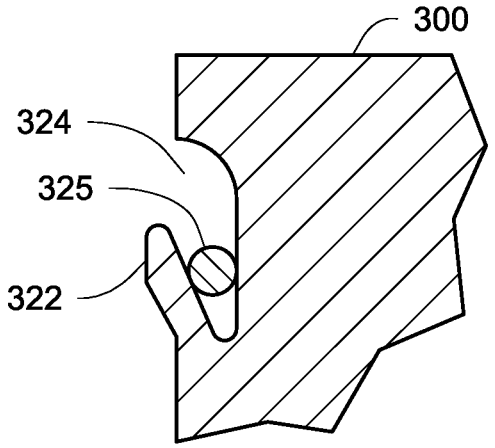

FIG. 4J includes the features illustrated in FIG. 4I, and additionally includes the seal activator 325 disposed in the area 324.

Figure 5:
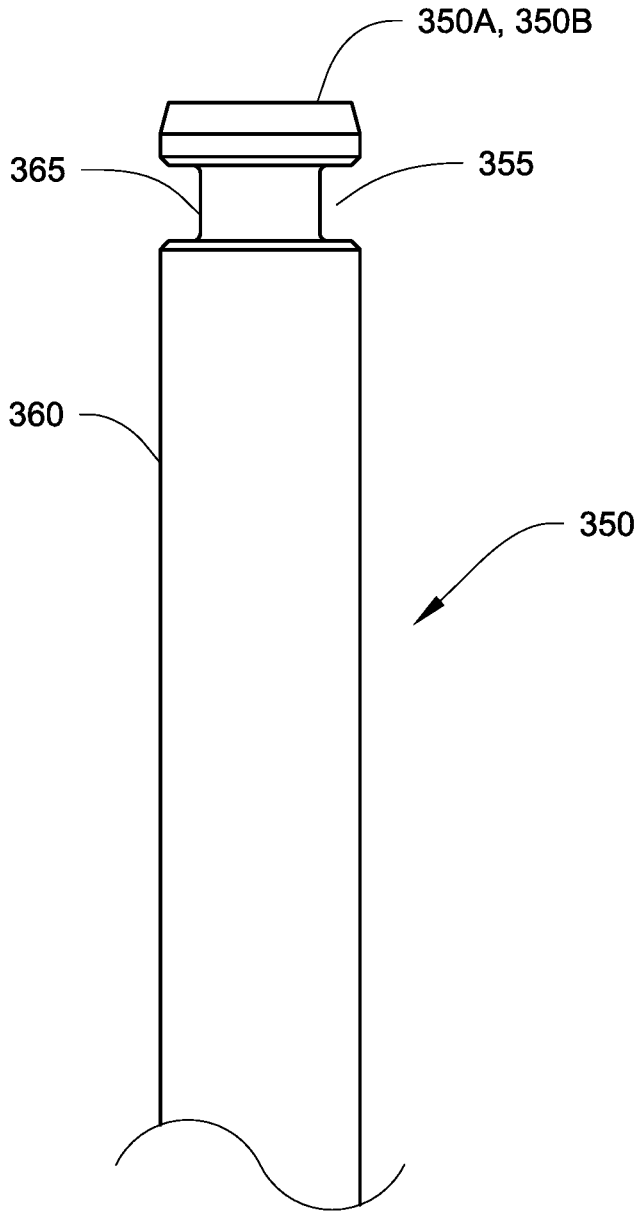
FIG. 5 shows a partial view of a conduit of the compressor in FIGS. 2A-2B, according to an embodiment.

FIG. 5 shows a partial view of the conduit 350, according to an embodiment. The partial view of the conduit 350 includes an end 350A, 350B of the conduit 350. As discussed above with respect to FIGS. 2A-2B, the conduit 350 fluidly connects the solenoid valve 150 with the unloading mechanism 300 to selectively determine whether the unloading mechanism is in the flow disabled state or the flow enabled state. It will be appreciated that the end 350A can be the same as or similar to the end 350B, and accordingly, the illustrated end is referred to as the end 350A, 350B. In an embodiment, either the end 350A or the end 350B can alternatively be permanently secured to the solenoid valve 150 or the non-orbiting scroll 26.

The conduit 350 is generally designed to be assembled by pressing the ends 350A, 350B of the conduit to the solenoid valve 150 and the non-orbiting scroll 26. Advantageously, this press-fit design can simplify a manufacturing process of the compressor 120. To provide a sealing engagement, the end 350A, 350B of the conduit 350 can include a groove 355. The conduit 350 can generally include an outer surface 360 and an inner surface 365. In the illustrated embodiment, the groove 355 can be formed by removing a portion of the outer surface of 360 of the 365 to expose the inner surface 365. In an embodiment, the groove 355 can be designed to receive a gasket (e.g., an O-ring or the like). It will be appreciated that in an embodiment, the groove 355 can be formed in a surface of the non-orbiting scroll 26 or the solenoid valve 150, such that the outer surface 360 of the conduit is not modified, but can form a sealing engagement with the non-orbiting scroll 26 or the solenoid valve 150 via a gasket maintained in the groove formed in the non-orbiting scroll or the solenoid valve 150.

Aspects:

It is to be appreciated that any one of aspects 1-19 can be combined with any one of aspects 20, 21, or 22. Any one of aspects 20 and 21 can be combined with aspect 22.

Aspect 1. A scroll compressor, comprising:

a compressor housing;

an orbiting scroll member disposed within the housing;

a non-orbiting scroll member disposed within the housing, wherein the orbiting scroll member and the non-orbiting scroll member are intermeshed thereby forming a compression chamber within the housing; and an endplate secured to the non-orbiting scroll member, the endplate including a check valve surface configured to provide a stop for a check valve of the scroll compressor, a radial sealing surface configured to receive a radial seal, an unloading mechanism surface configured to provide a stop for an unloading mechanism, and a pressure chamber for controlling the unloading mechanism, the endplate also including an aperture that fluidly connects the compression chamber and a discharge chamber of the scroll compressor.

Aspect 2. The scroll compressor according to aspect 1, wherein the endplate is a single member, formed of a unitary, one-piece construction.

Aspect 3. The scroll compressor according to any one of aspects 1-2, wherein the unloading mechanism includes a flow enabled state and a flow disabled state.

Aspect 4. The scroll compressor according to aspect 3, wherein in the flow enabled state, the unloading mechanism fluidly connects an intermediate location of the compression chamber and the discharge chamber, such that fluid discharged through the aperture is provided at an intermediate pressure that is between a suction pressure and a discharge pressure of the scroll compressor.

Aspect 5. The scroll compressor according to any one of aspects 3-4, wherein in the flow disabled state, the unloading mechanism fluidly closes the intermediate location of the compression chamber and the discharge chamber, such that fluid discharged through the aperture is provided at the discharge pressure of the scroll compressor.

Aspect 6. The scroll compressor according to any one of aspects 3-5, wherein the unloading mechanism is in the flow enabled state when operating at a part load, and in a flow disabled state when operating at a full load.

Aspect 7. The scroll compressor according to any one of aspects 1-6, wherein the unloading mechanism is a piston.

Aspect 8. The scroll compressor according to aspect 7, wherein the piston is configured to prevent a back flow of a working fluid of the scroll compressor from the discharge chamber to a suction side of the scroll compressor.

Aspect 9. The scroll compressor according to any one of aspects 7-8, wherein an outer surface of the piston is modified to form a seal between an inner surface of a chamber in which the piston is disposed, and the outer surface of the piston.

Aspect 10. The scroll compressor according to aspect 9, further comprising a piston seal, wherein the piston seal is configured to form the seal between the inner surface of the chamber and the outer surface of the piston.

Aspect 11. The scroll compressor according to any one of aspects 1-10, further comprising a solenoid valve secured to the compressor housing and configured to control the unloading mechanism.

Aspect 12. The scroll compressor according to aspect 11, wherein the solenoid valve is directly secured to the compressor housing via a resistance weld.

Aspect 13. The scroll compressor according to aspect 12, wherein the compressor housing includes a surface modified portion for receiving the solenoid valve.

Aspect 14. The scroll compressor according to any one of aspects 11-13, wherein the solenoid valve is fluidly connected to the non-orbiting scroll member via a plurality of conduits.

Aspect 15. The scroll compressor according to aspect 14, wherein the plurality of conduits include ends having a groove, the groove configured to provide a sealing engagement with the solenoid valve and the non-orbiting scroll member.

Aspect 16. The scroll compressor according to any one of aspects 15, wherein the grooves are formed by removing a portion of the conduits in a thickness direction.

Aspect 17. The scroll compressor according to any one of aspects 15-16, wherein the grooves have a depth that is less than a thickness of the conduits.

Aspect 18. The scroll compressor according to any one of aspects 14-17, wherein the plurality of conduits are securable to at least one of the solenoid valve and the non-orbiting scroll member via a press fit.

Aspect 19. The scroll compressor according to any one of aspects 14-18, wherein at least one end of the plurality of conduits is secured to one of the solenoid valve and the non-orbiting scroll member via a welded connection.

Aspect 20. An endplate for a scroll compressor, comprising:

a member including:

a check valve surface configured to provide a stop for a check valve of the scroll compressor, a radial sealing surface configured to receive a radial seal, an unloading mechanism surface configured to provide a stop for an unloading mechanism, and a pressure chamber for controlling the unloading mechanism, the endplate also including an aperture that fluidly connects the compression chamber and a discharge chamber of the scroll compressor.

Aspect 21. The endplate according to aspect 20, wherein the member is a single piece, unitary construction.

Aspect 22. A refrigerant circuit, comprising:

a compressor, a condenser, an expansion device, and an evaporator fluidly connected, wherein the compressor is a scroll compressor, the scroll compressor including:

a compressor housing;

an orbiting scroll member disposed within the housing;

a non-orbiting scroll member disposed within the housing, wherein the orbiting scroll member and the non-orbiting scroll member are intermeshed thereby forming a compression chamber within the housing; and an endplate secured to the non-orbiting scroll member, the endplate including a check valve surface configured to provide a stop for a check valve of the scroll compressor, a radial sealing surface configured to receive a radial seal, an unloading mechanism surface configured to provide a stop for an unloading mechanism, and a pressure chamber for controlling the unloading mechanism, the endplate also including an aperture that fluidly connects the compression chamber and a discharge chamber of the scroll compressor.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. An endplate for a scroll compressor, comprising:

a member including:

a radial sealing surface configured to receive a radial seal, an aperture that fluidly connects a compression chamber and a discharge chamber of the scroll compressor, and a bottom surface, the bottom surface including:

a check valve surface configured to provide a stop for a check valve of the scroll compressor, an unloading mechanism surface configured to provide a stop for an unloading mechanism configured to have a flow enabled state and a flow disabled state, and configured to be fluidly connected to a pressure chamber to control the unloading mechanism, wherein in the flow enabled state, the unloading mechanism is configured to fluidly connect an intermediate location of the compression chamber and the discharge chamber, such that fluid discharged through the aperture is provided at an intermediate pressure that is between a suction pressure and a discharge pressure of the scroll compressor.

2. The endplate according to claim 1, wherein the member is a single piece, unitary construction.

3. A scroll compressor, comprising:

a compressor housing;

an orbiting scroll member disposed within the housing;

a non-orbiting scroll member disposed within the housing, wherein the orbiting scroll member and the non-orbiting scroll member are intermeshed thereby forming a compression chamber within the housing;

a check valve;

an endplate having a bottom surface that is secured to the non-orbiting scroll member, the endplate including an aperture that fluidly connects the compression chamber and a discharge chamber of the scroll compressor and a radial sealing surface configured to receive a radial seal, the bottom surface of the endplate including:

a check valve surface configured to provide a stop for the check valve of the scroll compressor, and an unloading mechanism surface configured to provide a stop for an unloading mechanism, the unloading mechanism including a flow enabled state and a flow disabled state, and a pressure chamber to control the unloading mechanism and being formed between the endplate and the non-orbiting scroll member, wherein in the flow enabled state, the unloading mechanism fluidly connects an intermediate location of the compression chamber and the discharge chamber, such that fluid discharged through the aperture is provided at an intermediate pressure that is between a suction pressure and a discharge pressure of the scroll compressor.

4. The scroll compressor according to claim 3, wherein the endplate is a single member, formed of a unitary, one-piece construction.

5. The scroll compressor according to claim 1, wherein in the flow disabled state, the unloading mechanism fluidly closes the intermediate location of the compression chamber and the discharge chamber, such that fluid discharged through the aperture is provided at the discharge pressure of the scroll compressor.

6. The scroll compressor according to claim 1 wherein the unloading mechanism is in the flow enabled state when operating at a part load, and in the flow disabled state when operating at a full load.

7. The scroll compressor according to claim 1, wherein the unloading mechanism is a piston.

8. The scroll compressor according to claim 7, wherein the piston is configured to prevent a back flow of a working fluid of the scroll compressor from the discharge chamber to a suction side of the scroll compressor.

9. The scroll compressor according to claim 7, wherein an outer surface of the piston is modified to form a seal between an inner surface of a chamber in which the piston is disposed, and the outer surface of the piston.

10. The scroll compressor according to claim 1, further comprising a solenoid valve secured to the compressor housing and configured to control the unloading mechanism.

11. The scroll compressor according to claim 10, wherein the solenoid valve is directly secured to the compressor housing via a resistance weld.

12. The scroll compressor according to claim 11, wherein the compressor housing includes a surface modified portion for receiving the solenoid valve.

13. The scroll compressor according to claim 10, wherein the solenoid valve is fluidly connected to the non-orbiting scroll member via a plurality of conduits.

14. The scroll compressor according to claim 13, wherein the plurality of conduits are securable to at least one of the solenoid valve and the non-orbiting scroll member via a press fit.

15. The scroll compressor according to claim 13, wherein at least one end of the plurality of conduits is secured to one of the solenoid valve and the non-orbiting scroll member via a welded connection.

16. A refrigerant circuit, comprising:

a compressor, a condenser, an expansion device, and an evaporator fluidly connected, wherein a working fluid flows therethrough, and wherein the compressor is a scroll compressor, the scroll compressor including:

a compressor housing;

an orbiting scroll member disposed within the housing;

a non-orbiting scroll member disposed within the housing, wherein the orbiting scroll member and the non-orbiting scroll member are intermeshed thereby forming a compression chamber within the housing;

a check valve;

an endplate having a bottom surface that is secured to the non-orbiting scroll member, the endplate including an aperture that fluidly connects the compression chamber and a discharge chamber of the scroll compressor and a radial sealing surface configured to receive a radial seal, the bottom surface of the endplate including:

a check valve surface configured to provide a stop for a check valve of the scroll compressor, and an unloading mechanism surface configured to provide a stop for an unloading mechanism, the unloading mechanism including a flow enabled state and a flow disabled state, and a pressure chamber to control the unloading mechanism and being formed between the endplate and the non-orbiting scroll member, wherein in the flow enabled state, the unloading mechanism fluidly connects an intermediate location of the compression chamber and the discharge chamber, such that fluid discharged through the aperture is provided at an intermediate pressure that is between a suction pressure and a discharge pressure of the scroll compressor.

17. The refrigerant circuit according to claim 16, further comprising a part load operating state in which the unloading mechanism is in the flow enabled state.

* * * * *